US005092077A

United States Patent [19]

Teinturier-Milgram

[11] Patent Number: 5,092,077

[45] Date of Patent: Mar. 3, 1992

[54] DEVICE FOR PREVENTING FINGERS FROM JAMMING

[76] Inventor: Monique Teinturier-Milgram, 50, avenue Caffin, 94210 La Varenne Saint-Hilaire, France

[21] Appl. No.: 623,893

[22] PCT Filed: Apr. 26, 1990

[86] PCT No.: PCT/FR90/00301

§ 371 Date: Dec. 21, 1990

§ 102(e) Date: Dec. 21, 1990

[87] PCT Pub. No.: WO90/12945

PCT Pub. Date: Nov. 1, 1990

[30] Foreign Application Priority Data

Apr. 27, 1989 [FR] France ..... 89 05582
Mar. 13, 1990 [FR] France ..... 90 03177

[51] Int. Cl.[5] ..... E05D 11/00

[52] U.S. Cl. ..... 49/383; 160/40; 160/231.2

[58] Field of Search ..... 49/383, 397; 160/84.1, 160/231.1, 231.2, 229.1, 230, 40

[56] References Cited

U.S. PATENT DOCUMENTS

D. 227,913 7/1973 Ritzow et al. ..... 160/231.2 X
2,054,499 9/1936 Florman ..... 160/231.1 X
2,694,234 11/1954 Roby et al. ..... 49/383
2,795,272 6/1957 McBerty ..... 160/231.2 X
2,829,081 4/1958 Sweem ..... 160/84.1 X
2,894,573 7/1959 Rosenfeld ..... 160/84.1
3,385,001 5/1968 Bordner ..... 49/497 X
3,441,975 5/1969 Shepherd ..... 160/231.2 X
4,040,142 8/1977 Ippolito ..... 49/383 X
4,083,395 4/1978 Romano ..... 160/84.1
4,747,441 5/1988 Apolzer et al. ..... 160/84.1

*Primary Examiner*—Philip C. Kannan
*Attorney, Agent, or Firm*—Charles E. Baxley

[57] ABSTRACT

A safety device for equipping the vertical edge of a door and the adjacent jamb, on the hinge side, is formed of a rigid or semi-rigid elongate piece having longitudinal subdivision lines defining two marginal strips and a central zone of variable geometry. The marginal strips are adapted to be fixed respectively on the jamb and on the vertical edge of the door whereas the variable geometry zone projects freely outwards. The variable geometry zone is able to pass from a configuration which is at least relatively flattened, in the closed position of the door, to an opened out configuration in the open position of the door. The device is characterized in that, before fitting, it has a flat configuration.

2 Claims, 5 Drawing Sheets

DEVICE FOR PREVENTING FINGERS FROM JAMMING

The present invention relates to a safety device for equipping, over at least a part of their height, the vertical edge of a door and the adjacent jamb, on the hinge side, for preventing babies and young children from putting their fingers or hands in the passage left free between said door and said jamb, when the door is open.

The closure of doors by a third person, or even by an air current, daily causes accidents ranging from a simple traumatism of the phalanges by crushing to sectioning thereof: this is the most frequent cause of accidents occurring to small children.

Different devices have been proposed for remedying this situation and among them devices formed of a rigid or semi-rigid elongate piece having longitudinal subdivision lines defining two marginal strips and a central zone of variable geometry, said marginal strips being adapted to be fixed respectively on the jamb and on said vertical edge of the door whereas the variable geometry zone projects freely outside the jamb, said variable geometry zone being able to pass from a configuration which is at least relatively flattened, in the closed position of the door, to an opened out configuration in the open position of the door.

Such devices are described for example in FR-A-2 282 032, GB-A-2 203 473 and GB-A-2 019 475.

These known devices have a common drawback, that of being cumbersome to store and awkward to pack.

In fact, the device described in FR-A-2 282 032 is, as the applicant himself defines it, a bellows which involves a folded construction by manufacture.

The device described in GB-A-2 203 473 is a plastic V shaped strip, like the device described in GB-A-2 019 475 which, in addition, is provided with tongues at the free ends of the V and, outwardly, at the tip of the V.

The aim of the present invention is to overcome this drawback, which aim is reached in that a device is provided which has a flat configuration before fitting.

In a first embodiment, the strips and the variable geometry zone of the elongate piece forming the device are independent elements joined to a flexible material layer forming a common lining and, advantageously, the strips and the variable geometry zone are joined to the flexible material layer by an adhesive.

In a second embodiment, the strips and the variable geometry zone are formed in a single piece and defined by zones of material of lesser thickness allowing their articulation.

In a third embodiment, the strips and the variable geometry zone are independent elements included in a common envelope made from a flexible material.

In a fourth embodiment, the marginal strips and the variable geometry zone are independent elements joined together by a bridge of flexible material having high flexion strength.

In a first variant of the fourth embodiment, the longitudinal edges of each flexible material bridge merges with those of the adjacent strips.

In a second variant, each flexible material bridge has an H profile, the edge of the strips to be joined together being housed between the vertical bars of the H on each side of the horizontal bar thereof.

In a third variant, each flexible material bridge has a T profile, an edge of the strips to be joined together being housed along the two parts of the horizontal bar of the T on each side of the vertical bar thereof.

To facilitate articulation, one of the faces of the material bridge is advantageously concave.

Preferably, the marginal strips and the variable geometry zone are made from a rigid or semi-rigid plastic material, for example from polyvinyl chloride and the material bridges are made from a flexible plastic material for example from an alkylene (preferably butylene) terephthalate copolymer, having glycol polyether chains such as the product commercialized under the trademark Hytrel by E. I. Dupont de Nemours.

In practice, the variable geometry zone may be formed by at least two central strips.

In a preferred embodiment, the device is adapted to be placed on the external face of the door such as seen with respect to its opening direction, for it is from this external face that the passage offering danger is the most widely open.

However, the device according to the invention may also be adapted to be positioned on the inner face of the door such as seen with respect to the opening direction.

Preferably, the marginal strips and, respectively, the jamb and the edge of the door are joined in the rebate of the jamb and on the facing portion of the vertical edge of the door, so that in the closed position of the door, these marginal strips are hidden from view. To the knowledge of the Applicant, no prior known device has ever been fitted in this way: all have their marginal strips fixed on portions of the door and the jamb which are visible when the door is closed, so that the presence of these safety devices is much more apparent than that of the device according to the invention in its preferred mounting.

The invention will be better understood from the following description with reference to the accompanying drawings in which the thickness of the materials has been exaggerated for the sake of clarity and in which:

FIGS. 1 to 4 show, in cross section, a device according to the invention respectively in four different embodiments;

FIGS. 4*a* and 4*b* show in cross section a portion of the device of the invention, respectively in two variants of the embodiment of FIG. 4;

Figure 6:
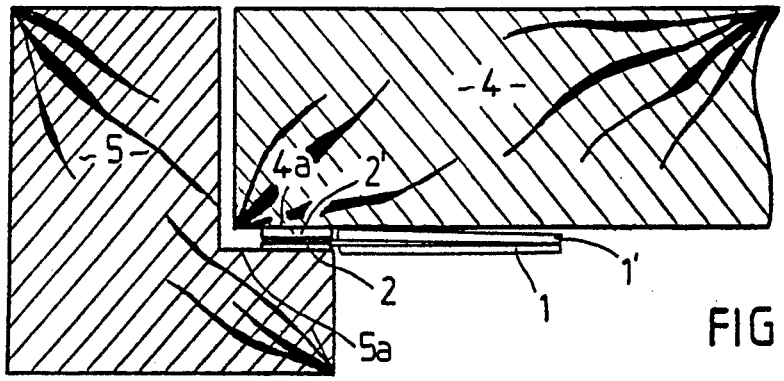
FIG. 6 is a section showing a jamb and a door portion equipped with a device of the invention, in any one of its embodiments shown schematically, the door being closed.
Figure 7:
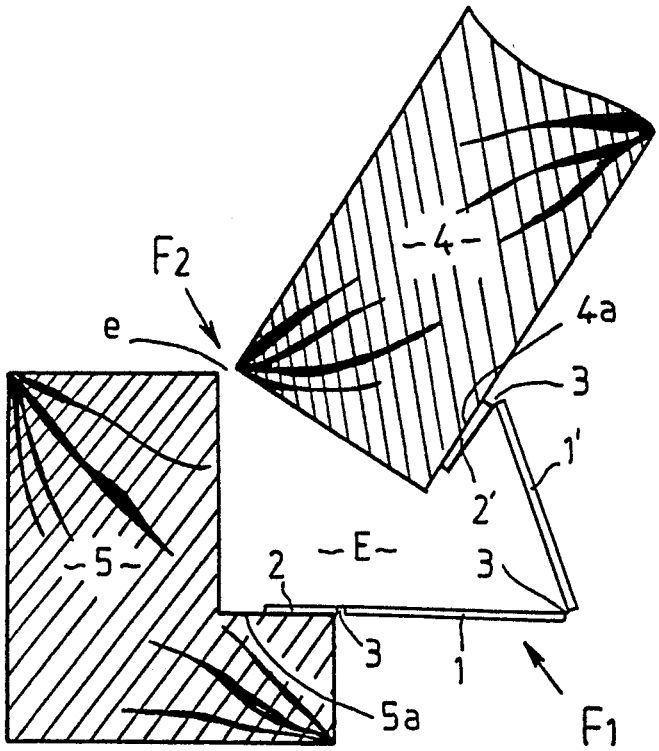
FIG. 7 is a view similar to FIG. 6, the door being open.
Figure 6A:
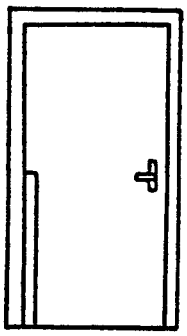
Figure 7A:
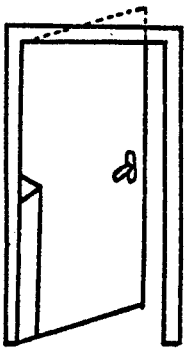
Figure 8:
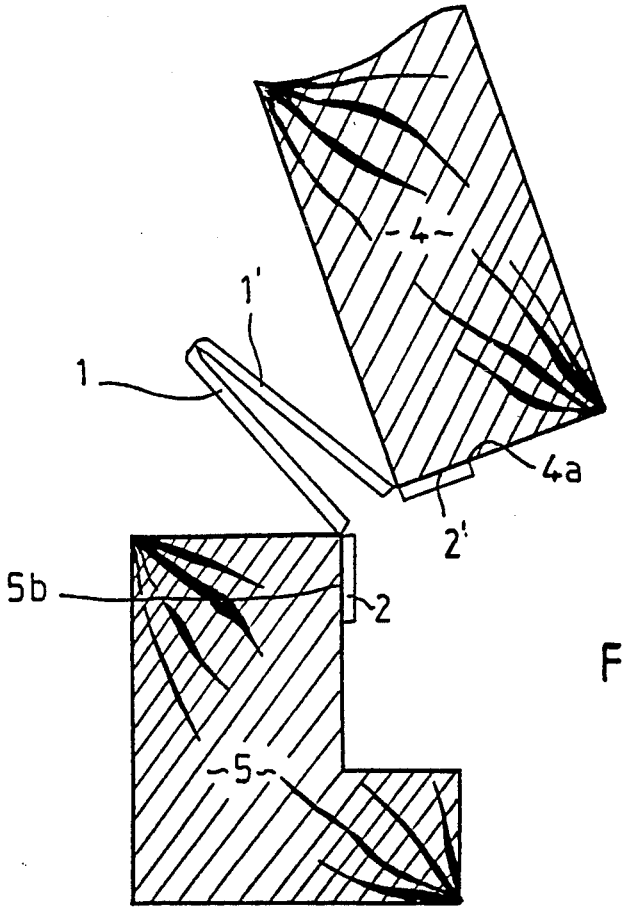

FIGS. 6*a* and 7*a* show schematically and on a smaller scale, in elevation, the door and the jamb equipped according to the invention respectively in the open and closed positions; and FIG. 8 is a view similar to FIG. 7 showing a device according to the invention fitted on the inside of the door, seen in the opening direction.

Figure 1:
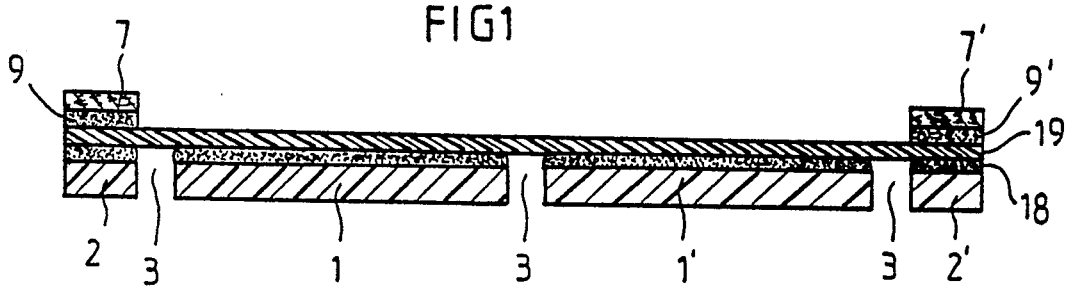
Figure 5:
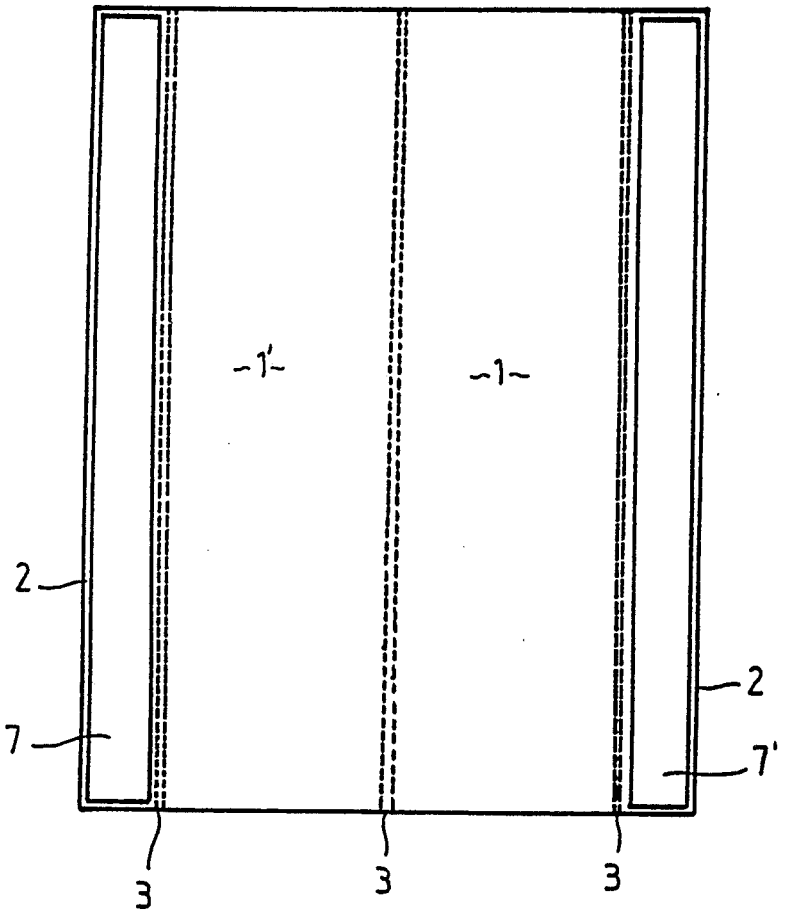
FIG. 5 is an elevational view of the device of FIG. 1 before fitting.

Referring to FIGS. 1 and 5, a device can be seen according to the invention; formed of two central strips 1, 1' and two marginal strips 2, 2'. The central and marginal strips are permanently fixed by an adhesive layer 18 to a flexible material panel or sheet 19. Facing the marginal strips 2, 2', the flexible material panel 19 is coated with a pressure adhesive 9, 9' covered with a removable protective strip 7, 7'.

It can then be seen that in the unused state, the device according to the invention is completely flat, which facilitates storage, packing and transport thereof.

The central 1, 1' and marginal 2, 2' strips are made from a rigid or semi-rigid resistant material, for example wood, polyvinyl chloride, polypropylene, rubber, or a metal such as aluminium, etc. . . . Their thickness is chosen both so that the marginal strips may be received in the functional clearance of the door (FIG. 6) and so that the central strips have the desired strength as a function of the nature of their component material. The width of the marginal strips 2, 2' is smaller than that of the central strips 1, 1' which depends on the opening angle of the door to be protected, 90° or 180°.

The material panel 19 must be both flexible and resistant, but substantially free of elasticity. It may for example be a polyvinyl chloride, polypropylene, very strong fabric, etc. . . . panel.

It will be understood that the articulations 3 of the device of FIG. 1 because of the absence of elasticity of panel 19, can only bend in a single direction. It can be further observed that all the articulations pivot in the same direction.

Figure 2:
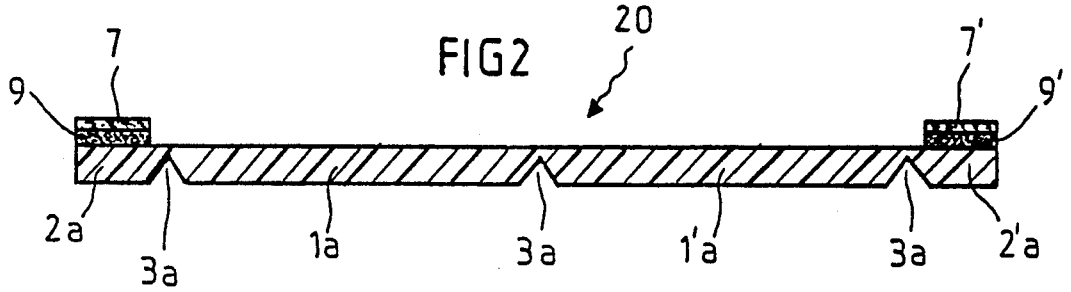

The embodiment of FIG. 2 is distinguished from that of FIG. 1 in that the device is not formed of independent strips, but of a single piece 20 having zones of lesser thickness forming articulations 3*a* between central strips 1*a*, 1'*a* and marginal strips 2*a*, 2'*a*. Such a piece 20 may be made from a heat formed plastic material.

In this embodiment, no panel 19 and consequently no adhesive 18 is provided. Since the material forming piece 20 has however to have both the rigidity which is expected of strips 1, 1', 2 and 2' of FIG. 1 and, at the level of its articulations 3*a*, the flexibility of articulations 3, it may be desirable to line the flat face of piece 20 with a panel similar to panel 19 and if, in order to obtain sufficient flexibility of articulations 3*a*, a thinness must be given to the zones of lesser thickness such that piece 20 is made fragile.

Figure 3:
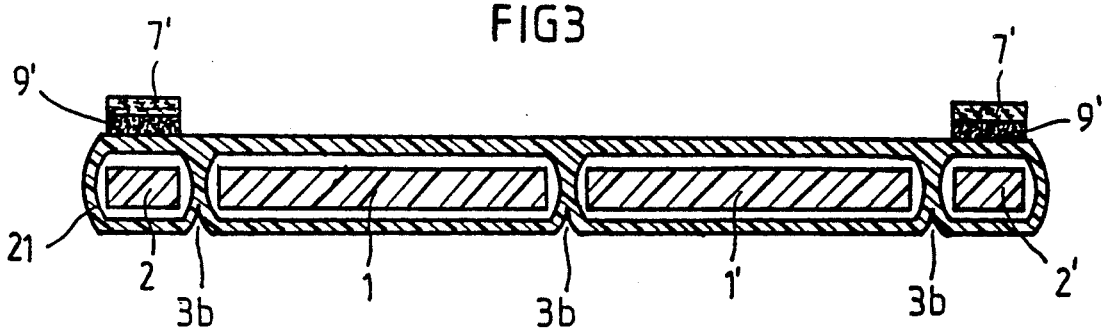

In the embodiment of FIG. 3, central strips 1, 1' and marginal strips 2, 2' are used separated from each other, but joined in an assembly by a common envelope 21 made from a material having the properties defined for panel 19. This envelope 21 has zones of lesser thickness on one of its faces so as to define articulations 3*b* between the strips.

Figure 4:
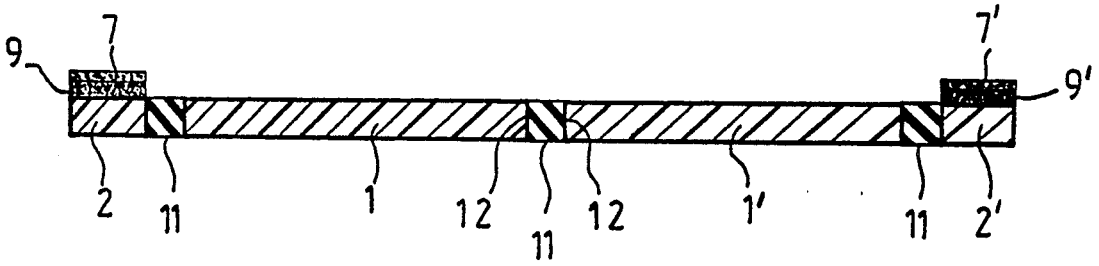

In the embodiment of FIG. 4, the central strips 1, 1' are joined together and to the marginal strips 2, 2' by a flexible plastic material bridge 11 having a high flexion strength. The longitudinal edges 12 of the material bridges 11 merge with those of the strips.

Figure 4A:
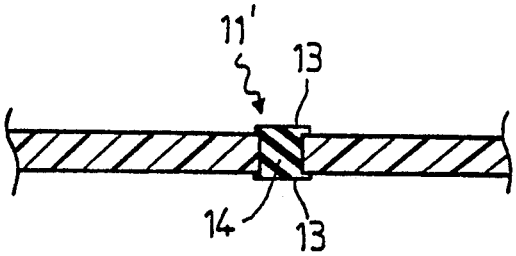

In the variant of FIG. 4*a*, the material bridge 11' has an H profile and the longitudinal edges of the strips are housed between the vertical bars 13 of the H on each side of its horizontal bar 14.

Figure 4B:
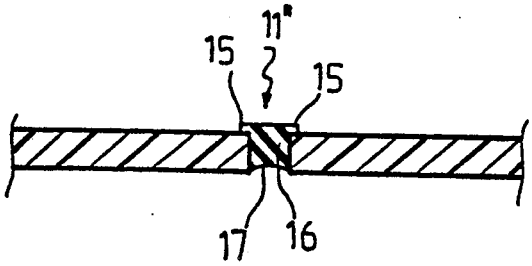

In the variant of FIG. 4*b*, the material bridge 11" has a T profile and one of the longitudinal edges of each of the strips extends along one of two portions of the horizontal bar 15 of the T on each side of its vertical bar 16. As can be seen, the face of bridge 11" opposite the horizontal bar 15 of the T is concave at 17, which facilitates flexion of the bridge 11".

The device shown in FIGS. 4, 4*a* and 4*b* may be manufactured by coextrusion of elements 1, 1', 2, 2' from a rigid or semi-rigid plastic material and bridges 11, 11', 11" from a flexible plastic material.

The use of the device of the invention will now be described.

As shown in FIGS. 6 and 7, after removal of the protective strips 7, the device may be bonded along its marginal strips 2, 2' with the pressure adhesive 9, respectively in the rebate 5*a* of a door jamb 5 and on the facing edge 4*a* of the door. As is clear from FIG. 6, in the closed position of the door, the marginal strips 2, 2' are housed in the functional clearance of the door and are invisible. They are just as hidden from view in the open position of the door, as can be seen from FIG. 7.

In the closed position of the door (FIGS. 6 and 6*a*), only the central strips 1, 1' project outwardly. In addition they are intimately applied one on the other against the door so that they form no unsightly protuberance dissuading use thereof, which is generally the case with prior known devices.

In the open position of the door (FIGS. 7 and 7*a*), the device opens out, preventing any access, in the direction of arrow Fl, to the space E freed between door 4 and jamb 5.

It may also be desirable to prevent a child from putting his fingers, in the direction of arrow F2, into the smallest space e freed between door 4 and jamb 5, on the inside of the door, seen in the opening direction. That may be achieved with a device such as shown in FIG. 8, which is distinguished from those described above by the fact that it is mounted on the rebate 5*b* of the jamb 5 and on the edge 4*b* of door 4.

The structure of the device according to the invention, whatever the embodiment, is such that the device may be produced in great lengths and cut according to the customer's wishes. It may also be sold in equal standard lengths either to the height usually reached by a five year old child, or to the height of standardized doors.

The invention is not limited to the embodiments described and shown. In particular, the device could comprise more than two central strips and the strips need not be of the same width. It could be fixed to doors and jambs by other means than bonding, for example nailed or screwed, but bonding is generally preferred because it is simple and clean and leaves no hole after removal, when the age of the child makes the device useless. An assembly could moreover be produced which prevents access not only to space E but also to space e, which assembly would then combine in a unitary whole two devices according to the invention to be installed between rebate and facing edge of the door.

Of course, although reference has been made to equipping a door and a jamb throughout the description and in the claims, the scope of the invention is not limited to such a use. The device may just as well be fitted between a window leaf and the adjacent woodwork, or in relation with any other similar pivoting assembly freeing a slot which is accessible and dangerous for the safety of children.

I claim:

1. A safety device for equipping, over at least a part of their height, the vertical edge of a door and the adjacent jamb, on the hinge side, which device is formed of a rigid or semi-rigid elongate piece having longitudinal subdivision lines defining two marginal strips and a central zone of variable geometry, said marginal strips being adapted to be fixed respectively on the jamb and on said vertical edge of the door whereas the variable geometry zone projects freely outwards, said variable geometry zone being able to pass from a configuration which is at least relatively flattened, in the closed position of the door, to an opened out configuration in the open position of the door, characterized in that, before fitting, the device has a flat configuration, in that the marginal strips and the variable geometry zone are independent rigid or semi-rigid elements joined together by a bridge of flexible material having high flexion strength, and in that each flexible material bridge has a T profile, an edge of the strips to be joined together being housed along the two parts of the horizontal bar of the T on each side of the vertical bar thereof.

2. A safety device for equipping, over at least a part of their height, the vertical edgc of a door and the adjacent jamb, on the hinge side, which device is formed of a rigid or semi-rigid elongate piece having longitudinal subdivision lines defining two marginal strips and a central zone of variable geometry, said marginal strips being adapted to be fixed respectively on the jamb and on said vertical edge of the door whereas the variable geometry zone projects freely outwards, said variable geometry zone being able to pass from a configuration which is at last relatively flattened, in the closed position of the door, to an opened out configuration in the open position of the door, characterized in that, before fitting, the device has a flat configuration, and in that the marginal strips and, respectively, the jamb and edge of the door are joined together in the rebate of the jamb and on the facing portion of the vertical edge of the door so that in the closed position of the door these marginal strips are hidden from view.

* * * * *